US008702022B2

(12) United States Patent
Scholz et al.

(10) Patent No.: US 8,702,022 B2
(45) **Date of Patent: *Apr. 22, 2014**

(54) ROLLER MILL WITH DRIVEN GRINDING ROLLER

(76) Inventors: Guido Scholz, Münster (DE); Pedro Guerrero Palma, Lippetal (DE); Heiko Fornefeld, Hamm (DE); Ludwig Könning, Ahlen (DE)

( * ) Notice: Subject to any disclaimer, the term of this patent is extended or adjusted under 35 U.S.C. 154(b) by 439 days.

This patent is subject to a terminal disclaimer.

(21) Appl. No.: 13/055,785

(22) PCT Filed: Aug. 24, 2009

(86) PCT No.: PCT/EP2009/060877

§ 371 (c)(1),
(2), (4) Date: Jan. 25, 2011

(87) PCT Pub. No.: WO2010/023182

PCT Pub. Date: Mar. 4, 2010

(65) Prior Publication Data

US 2011/0121116 A1 May 26, 2011

(30) Foreign Application Priority Data

Aug. 25, 2008 (DE) ..... 10 2008 039 542

(51) Int. Cl.
*B02C 19/00* (2006.01)

(52) U.S. Cl.
USPC ..... 241/101.2; 241/121

(58) Field of Classification Search
USPC ..... 241/117–121, 101.2
See application file for complete search history.

(56) References Cited

U.S. PATENT DOCUMENTS 1,885,251 A * 11/1932 Gaiser ..... 241/38
2,337,884 A * 12/1943 Julius ..... 74/391
4,896,837 A * 1/1990 Heinemann et al. ..... 241/12

FOREIGN PATENT DOCUMENTS

DE 3602932 8/1987
DE 19723100 12/1998

OTHER PUBLICATIONS

English translation for DE 3602932 (listed in IDS Jan. 25, 2011).*

* cited by examiner

*Primary Examiner* — Shelley Self
*Assistant Examiner* — Leonel Vasquez
(74) *Attorney, Agent, or Firm* — Renner Kenner Greive Bobak Taylor & Weber

(57) ABSTRACT

A roller mill includes a mill housing which defines a grinding chamber, a grinding table which can rotate in the grinding chamber and at least one rotatable grinding roller which is in rolling engagement with the grinding table. A drive which is associated with the grinding roller and which has at least one gearing mechanism is further provided, at least a portion of the gearing mechanism being arranged in the grinding chamber in the region of the grinding roller and being in the form of an epicyclic gear system.

14 Claims, 1 Drawing Sheet

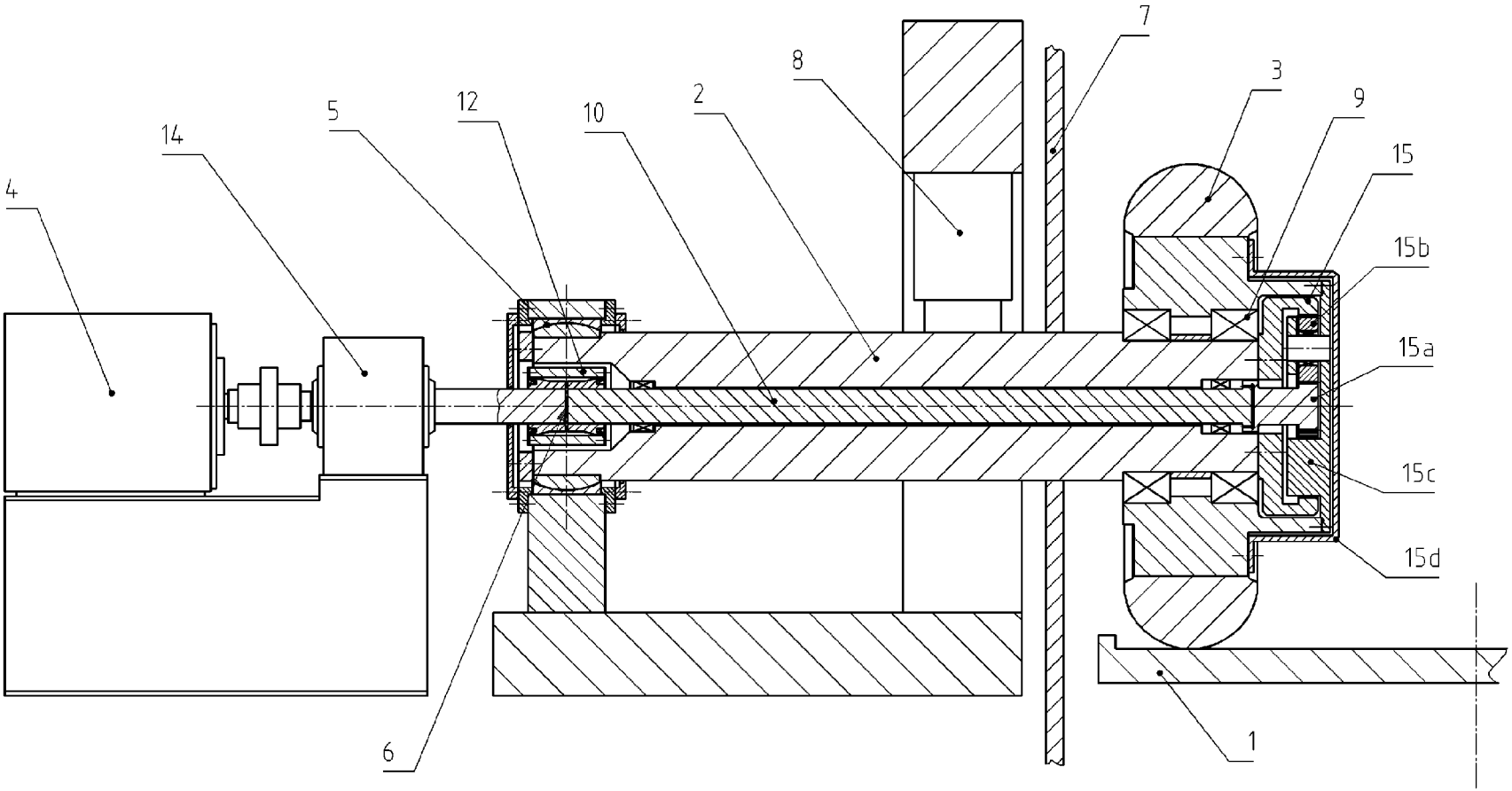
15
15b
15a
15c
15d
9
3
7
8
2
10
12
5
14
4
6
1

ROLLER MILL WITH DRIVEN GRINDING ROLLER

TECHNICAL FIELD

The invention relates to a roller mill having a grinding table which can rotate in a grinding chamber, at least one rotatable grinding roller which is in rolling engagement with the grinding table and at least one drive which is associated with the grinding roller.

BACKGROUND OF THE INVENTION

In roller mills used industrially, there is generally driven the grinding table which drives the grinding rollers via the grinding bed. In this instance, it is generally necessary to arrange a gearing mechanism below the grinding table. In mills having large throughputs, it is necessary to take into account high investment costs, long procurement times and unsatisfactory availability with such gearing mechanisms.

Therefore, it has already been proposed to drive the grinding rollers in place of the grinding table. If a plurality of grinding rollers are provided, it is thereby possible to distribute the power for driving the roller mill over a corresponding plurality of drives. In that manner, it is possible to use drives which are smaller and therefore cheaper.

In DE 38 01 728 C2 and DE 36 02 932 A1, the complete drive with the motor and gearing mechanism is provided on the pivot lever which retains the grinding roller. Owing to the substantial weight of the motor, increased demands are placed on the bearing of the pivot lever in this embodiment. The motor is further subjected to powerful vibrations owing to the grinding process.

DE 197 02 854 proposes a motor which is fixed in position as an alternative construction type. The drive power is transmitted to the gearing mechanism which is secured to the pivot lever via a cardan shaft. That cardan shaft has to ensure both angular compensation and longitudinal axial compensation.

Since very high torques have to be transmitted to the grinding roller, the drive train has to have such dimensions that it is relatively complex and expensive.

DE 295 563 further discloses an edge mill having a driven table and edge runner. The drive power of the edge runner is transmitted via a tooth engagement to a pinion gear, which engages with a ring gear, to the edge runner. The tooth engagement involving the pinion gear/ring gear is a conventional spur wheel mechanism.

SUMMARY OF THE INVENTION

Therefore, an object of the invention is to construct the drive of the roller mill more cheaply. This object is achieved according to the invention by the features of claim 1.

The roller mill according to the invention substantially comprises a mill housing which defines a grinding chamber, a grinding table which can rotate in the grinding chamber and at least one rotatable grinding roller which is in rolling engagement with the grinding table. A drive which is associated with the grinding roller and which has at least one gearing mechanism is further provided, at least a portion of the gearing mechanism being arranged in the grinding chamber in the region of the grinding roller and being in the form of an epicyclic gear system.

Since at least a portion of the gearing mechanism is arranged in the region of the grinding roller, the high torques are produced precisely where they are needed. It is thereby possible for the drive train which extends as far as the epicyclic gear system accordingly to have smaller dimensions, whereby the drive components can accordingly be produced and acquired more favourably. Reducing the masses in the drive train further reduces the mass moment of inertia. In turn, this makes adjusting and controlling the drive easier. Owing to the grinding process, the drive elements are subjected to acceleration forces so that the reduction in mass also has a positive effect on the configuration and durability of the bearings in this instance.

The dependent claims relate to other constructions of the invention.

The epicyclic gear system is preferably connected directly to the grinding roller and may be in the form of a power-splitting gearing mechanism, in particular a planet gear system. The planet gear system then has in particular a driven sun gear which is advantageously arranged for pivoting movement.

The grinding roller further has a grinding roller bearing, the grinding roller bearing and the epicyclic gear system having a common oil chamber.

According to a preferred embodiment of the invention, the grinding roller is retained for rotation on a pivot lever which is in the form of a hollow shaft. The drive further has a drive shaft which extends in the pivot lever which is in the form of a hollow shaft and which is coupled to the epicyclic gear system.

The drive further provides a motor which is preferably arranged so as to be fixed in position. There can also be provided an additional gearing mechanism which is fixed in position or which pivots with the pivot lever.

According to a particular embodiment of the invention, the epicyclic gear system is secured to the end-face end of the pivot lever that protrudes into the grinding chamber and advantageously has a wear protection member which can be changed.

The epicyclic gear system is further connected to a separate moment support which is arranged, for example, in the lateral guide of a pressing system also provided in order to adjust the pressing pressure of the grinding roller.

DETAILED DESCRIPTION OF THE INVENTION

The drawing is a partially sectioned side view of a roller mill.

The roller mill illustrated substantially comprises a rotatable grinding table 1, at least one grinding roller 3 which is rotatably retained on a pivot lever 2, and a drive train which is associated with the grinding roller in order to drive the grinding roller with a fixed motor 4. The pivot lever is arranged in a bearing 5 so as to pivot about a pivot lever axis 6 with an end outside a mill housing 7, whereas the grinding roller 3 is retained at the end of the pivot lever in the mill housing.

There is further provided a pressing system 8, in particular a hydropneumatic resilient system, in order to adjust the pressing pressure of the grinding roller 3. It is also arranged outside the mill housing 7 and is in operational contact with the pivot lever.

The grinding roller 3 is arranged for pivoting on the pivot lever 2 via a grinding roller bearing 9. The pivot lever 2 is further in the form of a hollow shaft so that a portion of the drive train in the form of a drive shaft 10 can be arranged in the hollow shaft.

The drive shaft 10 is operationally connected to the motor 4 arranged in a fixed manner outside the mill housing. One or more gearing mechanisms 14 could further be interposed. The gearing mechanism(s) can be arranged both so as to be fixed in position and on the pivot lever. Since a portion of the drive train is constructed in a fixed manner and another portion, in particular the drive shaft 10 which is arranged in the pivot lever 2, pivots with the pivot lever 2, there is provided a coupling 12 which compensates for the pivot movement of the pivot lever. In order to minimise the necessary compensation movements, the coupling 12 is preferably intended to be arranged in the pivot lever axis 6.

The coupling 12 is preferably a torsionally rigid compensation coupling, it particularly being possible to provide a curved-tooth coupling.

There is further provided in the drive train a co-rotating gearing mechanism which is in the form of an epicyclic gear system 15 and which is secured to the end of the pivot lever 2 in the region of the grinding roller 3. It is constructed as a power-splitting gearing mechanism and, in accordance with a preferred embodiment of the invention, as a planet gear system.

The epicyclic gear system is connected to the grinding roller and can be, for example, integrated in the grinding roller or fitted to the end-face end of the pivot lever 2 that is in the grinding chamber. It has, as usual, a sun gear 15*a*, a plurality of planet gears 15*b* and a planet carrier 15*c*. The sun gear 15*a* may be arranged for pivoting movement and is driven via the drive shaft 10. The planet carrier is connected to the grinding roller in a rotationally secure manner. The epicyclic gear system 15 is further protected by means of a wear protection member 15*d* which can preferably be changed. There is further intended to be provided a suitable moment support which could be formed, for example, by lateral guides of the pressing system 8.

According to another embodiment of the invention, there is provision for the grinding roller bearing 9, the bearing 5, the coupling 12 and, optionally, also the epicyclic gear system 15 to have a common oil chamber.

By using a power-splitting gearing mechanism in which, for example, more than one planet wheel is provided, the gear cutting may be carried out with a smaller module and a smaller tooth width. Consequently, the necessary construction space is minimised.

The epicyclic gear system arranged in the region of the grinding roller further has the advantage that the high torques are produced only where they are actually needed. This has the result that the moment and mass loading of the drive train arranged upstream can be reduced accordingly. That reduction in the torque allows the pivot movement of the pivot lever to be compensated for with a tooth coupling. During operation, there is produced owing to the grinding forces a bending of the pivot lever. The drive shaft 10 which is arranged in the pivot lever in the form of a hollow shaft is advantageously not subjected to any bending forces for reasons of strength and consequently does not conform to the bending line of the pivot lever. Consequently, the connection between the drive shaft 10 and the epicyclic gear system 15 must also be able to compensate for small angles. That angular compensation may occur in the tooth coupling owing to the relatively small torque.

The invention claimed is:

1. Roller mill comprising a mill housing which defines a grinding chamber, a grinding table which can rotate in the grinding chamber, at least one rotatable grinding roller which is in rolling engagement with the grinding table and at least one drive which is associated with the grinding roller and which has at least one gearing mechanism, characterised in that at least a portion of the gearing mechanism is arranged in the grinding chamber in the region of the grinding roller and is in the form of an epicyclic gear system.

2. Roller mill according to claim 1, characterised in that the grinding roller is connected to the epicyclic gear system.

3. Roller mill according to claim 1, characterised in that the epicyclic gear system is in the form of a power-splitting gearing mechanism.

4. Roller mill according to claim 1, characterised in that the epicyclic gear system is in the form of a planet gear system.

5. Roller mill according to claim 4, characterised in that the planet gear system has a driven sun gear.

6. Roller mill according to claim 5, characterised in that the sun gear is arranged for pivoting movement.

7. Roller mill according to claim 1, characterised in that the grinding roller has a grinding roller bearing and the grinding roller bearing and the epicyclic gear system have a common oil chamber.

8. Roller mill according to claim 1, characterised in that the grinding roller is retained for rotation on a pivot lever which is in the form of a hollow shaft.

9. Roller mill according to claim 8, characterised in that the pivot lever is in the form of a hollow shaft and the drive has a drive shaft that extends in the hollow shaft and is coupled to the epicyclic gear system.

10. Roller mill according to claim 1, characterised in that a pivot lever is directed through the mill housing and the grinding roller is retained at the end of the pivot lever that is in the grinding chamber, whereas the other end is arranged in a pivot bearing outside the mill housing.

11. Roller mill according to claim 1, characterised in that the drive has a motor and an additional gearing mechanism which is fixed in position.

12. Roller mill according to claim 1, characterised in that a pressing system is provided in order to adjust the pressing pressure of the grinding roller.

13. Roller mill according to claim 1, characterised in that the epicyclic gear system is secured to the end-face end of a pivot lever that protrudes into the grinding chamber.

14. Roller mill according to claim 1, characterised in that the epicyclic gear system is provided with a wear protection member which can be changed.

* * * * *